United States Patent [19]

Witte

[11] 4,333,267

[45] Jun. 8, 1982

[54] PROTECTIVE SLEEVE FOR PLANTS

[75] Inventor: Earl R. Witte, Richfield, Wis.

[73] Assignee: Meridian Industries Inc., Milwaukee, Wis.

[21] Appl. No.: 144,658

[22] Filed: Apr. 28, 1980

[51] Int. Cl.[3] ..... A01G 9/02

[52] U.S. Cl. ..... 47/84; 206/423; 229/87 P

[58] Field of Search ..... 47/1.1, 84; 206/423; 229/87 P, DIG. 13

[56] References Cited

U.S. PATENT DOCUMENTS

| | | | |
|---|---|---|---|
| 3,376,666 | 4/1968 | Leonard | 229/87 P |
| 4,063,383 | 12/1977 | Green | 47/1.1 |

FOREIGN PATENT DOCUMENTS

| | | | |
|---|---|---|---|
| 671378 | 2/1966 | Belgium | 47/84 |
| 2501691 | 7/1976 | Fed. Rep. of Germany | 206/423 |
| 1412009 | 8/1965 | France | 47/84 |
| 7701307 | 8/1977 | Netherlands | 206/423 |

*Primary Examiner*—James R. Feyrer

*Attorney, Agent, or Firm*—Andrus, Sceales, Starke & Sawall

[57] ABSTRACT

A protective sleeve for plants or flowers composed of a pair of sheets of material which are joined together along their side edges to form a tapered tubular sleeve to house the plant. At least one of the sheets is formed of porous, spun bonded synthetic fibrous material to permit circulation of air within the sleeve and enable the plant to be watered directly through the sleeve. The sleeve, due to the use of the spun bonded fibrous sheet, has substantial strength so that the plant can be lifted and handled by grasping the upper end of the sleeve.

5 Claims, 5 Drawing Figures

FIG.1
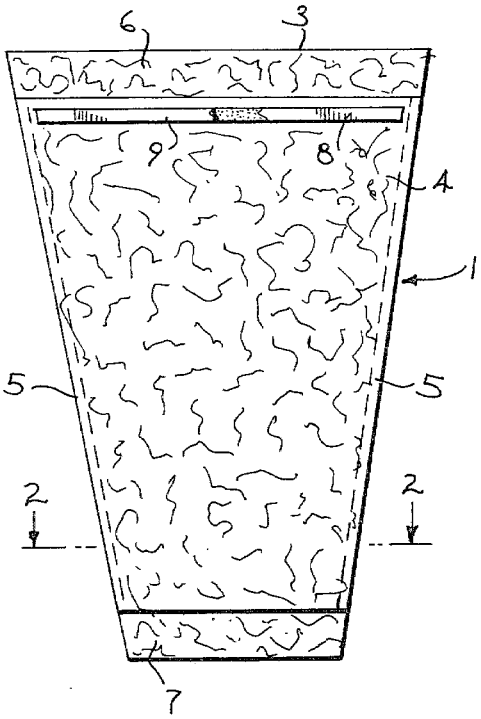
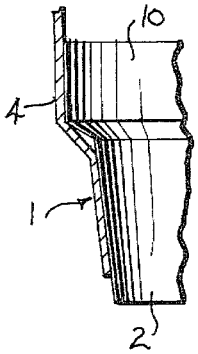
FIG. 4
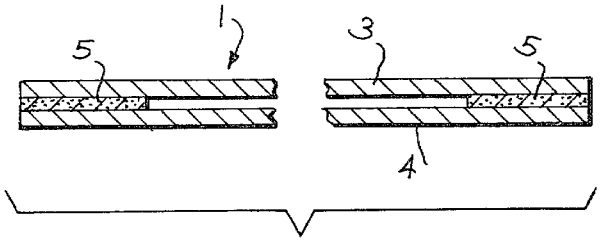
FIG. 2
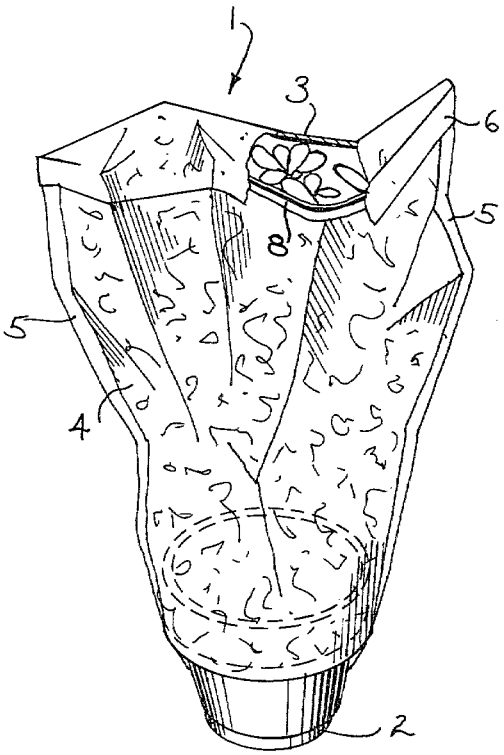
FIG. 3
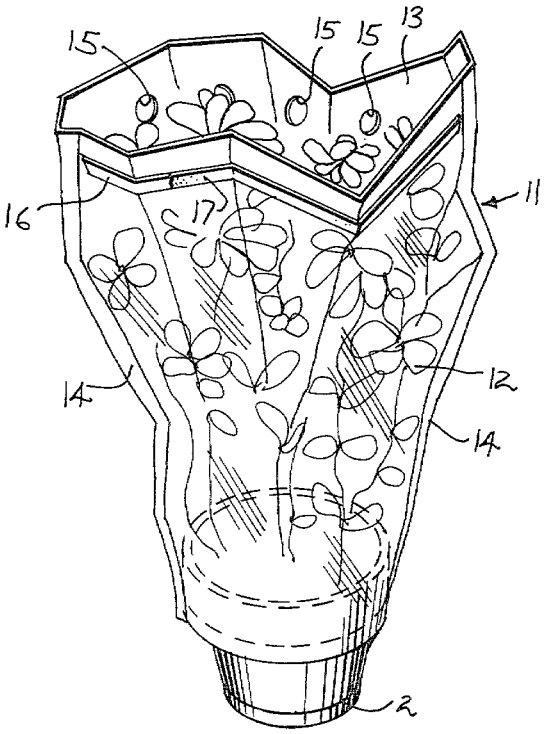
FIG. 5

PROTECTIVE SLEEVE FOR PLANTS

BACKGROUND OF THE INVENTION

Floral or foliage growers normally ship potted plants to florists or wholesalers in protective sleeves in order to protect the plant during shipment and handling. In the past, the protective sleeves have been formed of sheets of Kraft paper or polyethylene film, which are formed in the shape of a tapered tubular sleeve. The upper edges of the sleeves are stapled or otherwise secured to a holder or wicket, and in use, one workman will hold the sleeve in an open position, while a second workman will drop the potted plant into the open sleeve. The sleeve containing the plant is then removed from the wicket.

The plastic film sleeves, as used in the past, are impervious and thus prevent the circulation of air through the sleeve. As the plastic film sleeves are normally applied in warm climates where the flowers are grown, the plastic film, being soft and pliable, will tend to collapse over the plant and cling together which further restricts circulation. Due to the impervious nature of the plastic film, condensation occurs within the sleeve, and the lack of circulation in combination with the condensation, can cause rapid deterioration of the plant. Attempts have been made to improve the circulation of the plastic film sleeves by forming the sleeves with a plurality of holes, but the holes do not appreciably aid the circulation and decrease the strength of the sleeve.

As a further disadvantage of the plastic sleeve, it is not possible to water the plant directly in the sleeve due to the impervious nature of the plastic film. To water the plant, the upper end of the sleeve must be spread apart and water introduced directly onto the top of the plant.

The Kraft paper sleeves, as used in the past, have certain advantages over the plastic film in that the Kraft paper will stand upright but the paper sleeve restricts air circulation. Moreover, the Kraft paper sleeve lacks strength, particularly if the paper is wet, either due to outside water or condensation. As a further disadvantage, the plant cannot be watered when contained within a paper sleeve.

SUMMARY OF THE INVENTION

The invention is directed to an improved protective sleeve for potted plants and cut flowers. The sleeve, in accordance with the invention, is formed of a pair of sheets or panels of porous, spun bonded, non-woven, synthetic, fibrous material, such as polyester fibers. The sheets are joined together along their side edges to form a tapered tubular sleeve to house the plant or flowers.

Due to the porous nature of the spun bonded fibrous material, air can freely circulate through the sleeve and the plant can be watered directly through the sleeve. The spun bonded fibrous material has sufficient strength so that the plant can be lifted and handled by grasping the upper end of the sleeve.

The sleeve of the invention, being porous, permits free circulation of air which minimizes the deterioration of the plant while it is maintained within the sleeve. Furthermore, as the sleeve is porous, it can be watered directly in the sleeve and the synthetic fibrous material will not absorb moisture, so that it will not loose its strength.

In an alternate form of the invention, one of the sheets is formed of transparent plastic film, such as polyethylene film. The combination of the spun bonded fibrous material and the clear plastic film has advantages particularly when the plants are to be shipped to mass merchandisers. In this situation, the merchandiser can leave the plant within the sleeve for extended periods of time, and because of the porous spun bonded section, adequate air circulation is obtained and the plant can be watered directly in the sleeve. The use of the clear plastic film sheet enables the plant to be more readily viewed by the customer, and yet the combination of materials provides sufficient strength so that the plant can be lifted and handled by grasping the upper end of the sleeve.

Other objects and advantages will appear in the course of the following description.

DESCRIPTION OF THE DRAWINGS

The drawings illustrate the best mode presently contemplated of carrying out the invention.

In the drawings:

FIG. 1 is a plan view of the protective sleeve of the invention;

FIG. 2 is a section taken along line 2—2 of FIG. 1;

FIG. 3 is a perspective view showing a potted plant retained within the sleeve;

FIG. 4 is a fragmentary vertical section showing the sleeve in contact with the pot; and FIG. 5 is a perspective view showing a modified form of the protective sleeve.

DESCRIPTION OF THE PREFERRED EMBODIMENT

FIGS. 1–4 illustrate a protective sleeve 1 to house a potted plant 2. The sleeve 1 is composed of a pair of generally trapazoidal-shaped sheets 3 and 4 which are joined along their side edges by a sealed joint 5. As best illustrated in FIG. 1, the sheet 3 has a greater length than the sheet 4, so that the upper edge 6 and lower edge 7 of sheet 3 project beyond the corresponding edges of the sheet 4. The sheets 3 and 4 are connected by the joints 5 to provide a tapered, tubular sleeve which receives the potted plant 2, as illustrated in FIG. 3. While the drawings show the sleeve used to protect a potted plant, it is also contemplated that the sleeve can be used to protect cut flowers or foliage plants, as well.

The sheets 3 and 4 are formed of spun bonded randomly arranged, synthetic fibers, such as polyester or nylon fibers, and the sheets have a density in the range of 0.4 to 1.5 oz./sq.yd. The spun bonded fibrous material is porous, so that air can circulate freely through the sleeve. Because of the porous nature of the material, the plant can be watered directly through the sleeve.

The joint 5 preferably comprises an adhesive strip, preferably a hot melt resin, having a substantial width of about $\frac{3}{8}$ inch. This adhesive joint will provide an adequate connection between the two sheets, so that the plant can be lifted and handled by grasping the upper open end of the sleeve.

If desired, the upper end of the sleeve can be folded over and sealed to protect the plant against insect infestation during the growing stage or during shipment. In this regard, a double sided adhesive strip 8 can be applied to the upper edge of the sheet 4 and the outer surface of strip 8 is covered by a removable release layer 9. To close off the sleeve, the release layer 9 is removed, and the projecting edge 6 of sheet 3 is folded over and brought into contact with the adhesive strip 8, as illustrated in FIG. 3. It is contemplated that other types of closure or fastening mechanisms can be used in place of the adhesive strip 8.

In use, the sleeves 1 are stapled, or otherwise secured, to a wooden wicket or holder, not shown, through the upper exposed edges 6. In use, a workman holds the sleeve in an open condition, while a second workman will drop the potted plant 2 into the open sleeve. The sleeve is then removed from the wicket. As the sleeve is tapered, the pot will be held in the lower end, as shown in FIG. 3. If desired, the edge 6 can then be folded over and sealed as previously described.

Due to the stretchable nature of the spun bonded, fibrous material, the sleeve is capable of conforming to various sizes and shapes of pots. As the pot is dropped into the sleeve, the lower end of the sleeve will stretch to accommodate the contour of the pot so that the sleeve will be in snug contact with both the upper flange or rim 10 of the pot as well as the body of the pot. This provides an increased area of support for the pot and reduces stress concentrations on the sleeve.

FIG. 5 shows a modified form of the invention in which the tapered sleeve 11 is formed of a sheet 12 of spun bonded porous material, similar to sheets 3 and 4, and a second sheet 13 of transparent plastic film, such as polyethylene film. The sheets 12 and 13 are joined along their side edges by adhesive strips 14, similar to that previously described. To improve the circulation, the plastic film 13 can be provided with a series of air holes 15. The sleeve can also include a sealing strip 16, similar to strip 8, covered with a release layer 17.

The structure shown in FIG. 5 has advantages particularly when the plants are shipped to a mass merchandiser. As the sheet 12 of the sleeve 11 is formed of porous, spun bonded fibrous material, air can freely circulate within the sleeve to prevent deterioration of the plant and the plant can be watered directly in the sleeve while it is being displayed by the merchandiser.

The clear transparent sheet 13 provides a better view of the plant to the customer. Thus, with this construction, it is not necessary to remove the plant from the sleeve while being displayed by the merchandiser and it eliminates the necessity of resleeving the plant for handling and transporting by the customer.

While the sleeve of the invention has particular use by the grower to transport plants to the florist, merchandiser, or wholesaler, it can also be used by the grower in the finished growing stage to reduce the required greenhouse bench space. By placing the plants in the protective sleeves during the final growing stage, the plants can be placed closer together, thus reducing the bench space and correspondingly reducing the energy costs for heating the greenhouse. Conversely, a greater number of plants can be grown in a given bench space.

The term "plant" as used in the specification and claims is intended to cover potted plants and flowers, as well as cut flowers and foliage plants.

Various modes of carrying out the invention are contemplated as being within the scope of the following claims particularly pointing out and distinctly claiming the subject matter which is regarded as the invention.

I claim:

1. In combination, a pot to contain a plant and having a tapered body portion and a rim extending outwardly from the upper end of the body portion; and a protective open-ended sleeve surrounding the pot and the plant, said sleeve comprising a first sheet of material having a generally trapezoidal shape, a second sheet of material having a generally trapezoidal shape and disposed flatwise with respect to the first sheet, connecting means for joining the side edges of the sheets together to form a tapered sleeve to receive the plants, said sleeve having an open lower end and an open upper end, at least one of said sheets being formed of porous, spun bonded, randomly oriented synthetic fibrous material, each sheet having an upper edge and a lower edge and a pair of side edges that converge in a direction from the upper edge to the lower edge, the upper edge of a first of said sheets extending upwardly beyond the corresponding upper edge of the second sheet to provide a projecting end portion, said projecting end portion being foldable to enclose the open end of the sleeve and provide a complete enclosure for the plant, whereby the plant can be watered through the enclosed sleeve and air can circulate through the sleeve, the open lower end of said sleeve disposed in snug engagement with both the rim and the body portion of the pot.

2. The protective sleeve of claim 1, wherein said second sheet comprises transparent plastic film.

3. The protective sleeve of claim 2, wherein said plastic film is provided with a plurality of holes to improve air circulation through the sleeve.

4. The protective sleeve of claim 1, wherein said second sheet is composed of porous spun bonded randomly oriented synthetic fibrous material.

5. The protective sleeve of claim 1, and including closure means for enclosing the open upper end of the sleeve.

* * * * *